US005331931A

United States Patent [19]

Blish et al.

[11] Patent Number: 5,331,931

[45] Date of Patent: Jul. 26, 1994

[54] VARIABLE INTAKE VALVE

[76] Inventors: Nelson A. Blish, 302 Cove Creek, Houston, Tex. 77042; Ronald L. Chichester, 2746 Sherwood Hollow La., Kingwood, Tex. 77339

[21] Appl. No.: 70,595

[22] Filed: Jun. 1, 1993

Related U.S. Application Data

[60] Continuation-in-part of Ser. No. 674,107, Mar. 25, 1991, abandoned, which is a continuation-in-part of Ser. No. 360,320, Jun. 2, 1989, Pat. No. 5,016,583, which is a division of Ser. No. 144,549, Jan. 13, 1988, Pat. No. 4,864,984, which is a continuation-in-part of Ser. No. 902,633, Sep. 2, 1986, abandoned.

[51] Int. Cl.[5] ..... F01L 1/04

[52] U.S. Cl. ..... 123/90.11; 123/90.16; 123/90.17; 123/90.31

[58] Field of Search ..... 123/90.11, 90.15, 90.16, 123/90.17, 90.31, 90.48

[56] References Cited

U.S. PATENT DOCUMENTS

| | | | |
|---|---|---|---|
| 4,870,930 | 10/1989 | Yagi | 123/90.11 |
| 4,917,056 | 4/1990 | Yagi et al. | 123/90.11 |
| 5,140,955 | 8/1992 | Sono et al. | 123/90.11 |
| 5,161,494 | 11/1992 | Brown, Jr. | 123/90.11 |

FOREIGN PATENT DOCUMENTS

| | | | |
|---|---|---|---|
| 3307852 | 9/1984 | Fed. Rep. of Germany | 123/90.11 |
| 2608675 | 6/1988 | France | 123/90.31 |
| 162312 | 9/1984 | Japan | 123/90.11 |

*Primary Examiner*—E. Rollins Cross
*Assistant Examiner*—Weilun Lo
*Attorney, Agent, or Firm*—Nelson A. Blish

[57] ABSTRACT

An internal combustion engine (10) with intake valve (26) that may be kept open for a variable amount of time during the combustion cycle depending on operating conditions of the engine. Cam (22) rotates approximately 45° clockwise to depress poppet (26) moving the intake valve to the open position. Cam (22) is held in the open position by lip (25) on seat (23) of the poppet valve. A step motor is used to rotate cam ( 22 ) to an open or closed position. The step motor may be deenergized while the poppet valve is in the open or shut position. In another embodiment the amount the valve is opened may be varied.

7 Claims, 3 Drawing Sheets

VARIABLE INTAKE VALVE

This is a Continuation in Part of U.S. patent application Ser. No. 674,107 filed Mar. 25, 1991; now abandoned, which is a a Continuation in Part of U.S. Pat. No. 5,016,583 filed Jun. 2, 1989; which is a division of U.S. Pat. No. 4,864,984, filed Jan. 13, 1988; which is a Continuation in Part of U.S. patent application Ser. No. 902,633 filed Sept. 2, 1986 now abandoned.

BACKGROUND OF THE INVENTION

This invention relates to automobile engines in general and in particular to intake and exhaust valves that can be kept open for a variable amount of time, and the point in the combustion cycle at which the valve opens can be varied.

It is known that the optimum length of time the intake valve is kept open on the intake cycle will vary with conditions. For example, as an engine runs faster, the intake valve should be left open longer to allow the same volume of air and fuel into the cylinder. Also, if the engine is run at higher elevations where atmospheric pressure is less, the intake valve should be left open longer to get the same volume of air into the cylinder.

Previous attempts to solve this problem have not met with great success. One prior art method to solve this problem increased the length of the stroke of the intake poppet valve at high speeds. This was accomplished by using a second cam with a larger lobe, that would engage when the revolutions per minute (rpm) exceeded a certain value, pushing the poppet valve further into the cylinder, thus keeping the valve open longer.

This worked well in some instances but had some significant drawbacks. The binary positioning of the valve was not conducive to optimum engine output over the entire range of engine speeds. That is, the valve had only two open positions, and was shifted from one to the other at a fixed, nonvariable rpm value.

Other prior art attempts to achieve the objectives of this invention have not succeeded. Mingers FR2608-67-A discloses an electronic control system and alters the position of the cam shaft relative to the crankshaft depending on engine operating conditions. This, however, does not vary the length of time the valve is open or shut during the engine cycle, does not provide for maintaining the motor deenergized. During the open or shut position as in the present invention, Huber DE3307-852-A shows a cam follower which is slidable to change the curvature of the cam follower presented to the cam. This changes the point in the combustion cycle that the valve opens and closes. It does not, however, change the length of the time the valve is open as in the present invention.

SUMMARY OF THE INVENTION

A valve for an internal combustion engine according to the present invention utilizes an operating means that moves the valve between two stable positions, an open position and a closed position. The operating means is energized to move the valve to the open position or the closed position, but need not be energized while the valve is in the open or closed position. Thus there is no need for the coil to remain energized, if the operator is an electric motor, while the valve is in the open position or in the closed position. This reduces the chance of burning up the operating means. Also, the valve can be kept in the closed position or the open position, independent of the position of the piston, allowing the intake valve to be kept open longer at high rpm. The exhaust valve or intake valve or both could be kept open during operation to unload the cylinder if the particular cylinder was malfunctioning.

DETAILED DESCRIPTION OF THE DRAWINGS

Figure 1:
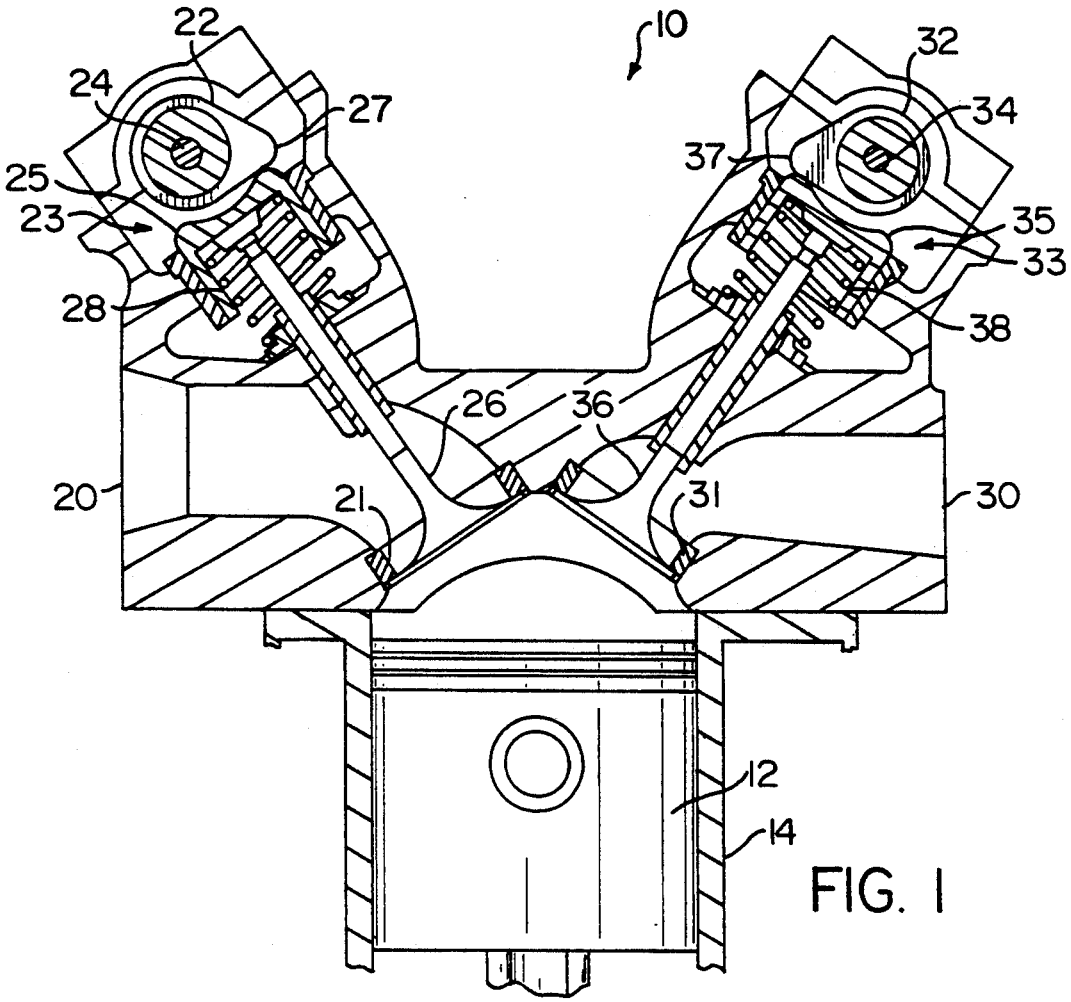
FIG. 1 shows a cross section of a engine according to the present invention.

FIG. 1 shows an internal combustion engine referred to in general by numeral 10. The major components of engine 10 are piston 12, cylinder 14, intake poppet valve 26, and exhaust poppet valve 36. Engine 10 operates in a manner similar to conventional combustion engines and uses a spark plug, not shown, to ignite an a gas air mixture in cylinder 14 to drive piston 12.

The innovative feature of this engine resides in the operation of intake valve 26 and exhaust valve 36. Intake valve 26 and exhaust valve 36 are similar in structure and operation. Intake valve 26 is held in a closed position against back seat 21 by spring 28. During the intake cycle, cam 24 rotates so that lobe 27 pushes cam seat or cam follower 23 downward against spring pressure, forcing intake valve 26 inward, off seat 21, and into the open position. In the open position, a fuel-air mixture enters from port 20 into cylinder 14.

In prior art engines, camshaft 24 rotates continuously at a rate proportional to the rpm of the engine. Therefore the intake valve 26 remains open only during the period of time lobe 27 is depressing seat 23. It is readily seen that an increase in the speed of the prior art engine will only increase the frequency at which the intake valve is opened and not increase the amount of time the valve stays open.

Figure 2:
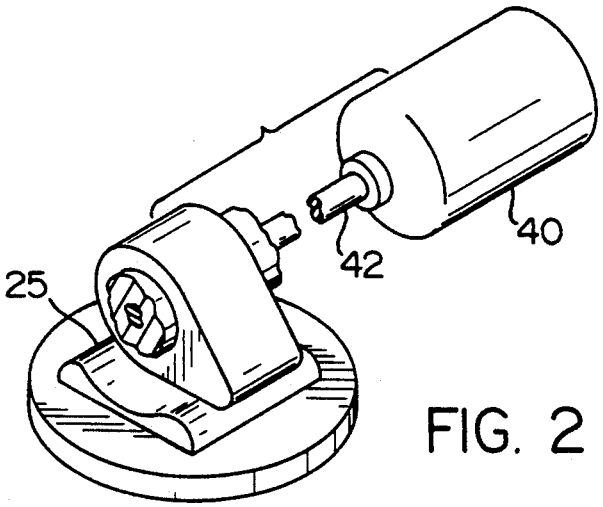
FIG. 2 shows an enlarge, perspective view of the cam and operating means in section A of FIG. 1.

In the present invention, the rotation of cam 22 is controlled by a motor 40 shown in FIG. 2. In the preferred embodiment, motor 40 is a stepper motor which can be rotated to one of two positions. In the first position shown in FIG. 1 and 2, the intake valve 26 is in the closed position. When motor 40 rotates approximately 45 degrees clockwise, intake valve 26 is moved to the open position.

There are two lips 25, on seat 23. These lips keep lobe 27 lined up, in a stable position, when valve 26 is in the open position. If seat 26 were flat, vibration of the engine might cause lobe 27 to rotate allowing valve 26 to close.

Since Cam 22 is stable in two positions, the open and closed position, motor 40 need not be energized when the valve is in either the open or closed position. This prolongs the life of motor 40 and eliminates the need to have electrical means energized to hold the valve in the open or closed position.

One advantage of this embodiment of the invention is that it uses poppet valves similar to those currently used in the automotive industry. Thus, there is little additional tooling necessary to implement the invention. The single additional feature needed is the electric stepping motor. Electronics have become thoroughly integrated into the modern automotive engine, for example, the ignition system uses electronic timing. Thus this innovation does not require major new engineering, but could use the electronic ignition system to activate the stepper motor.

Figure 3:
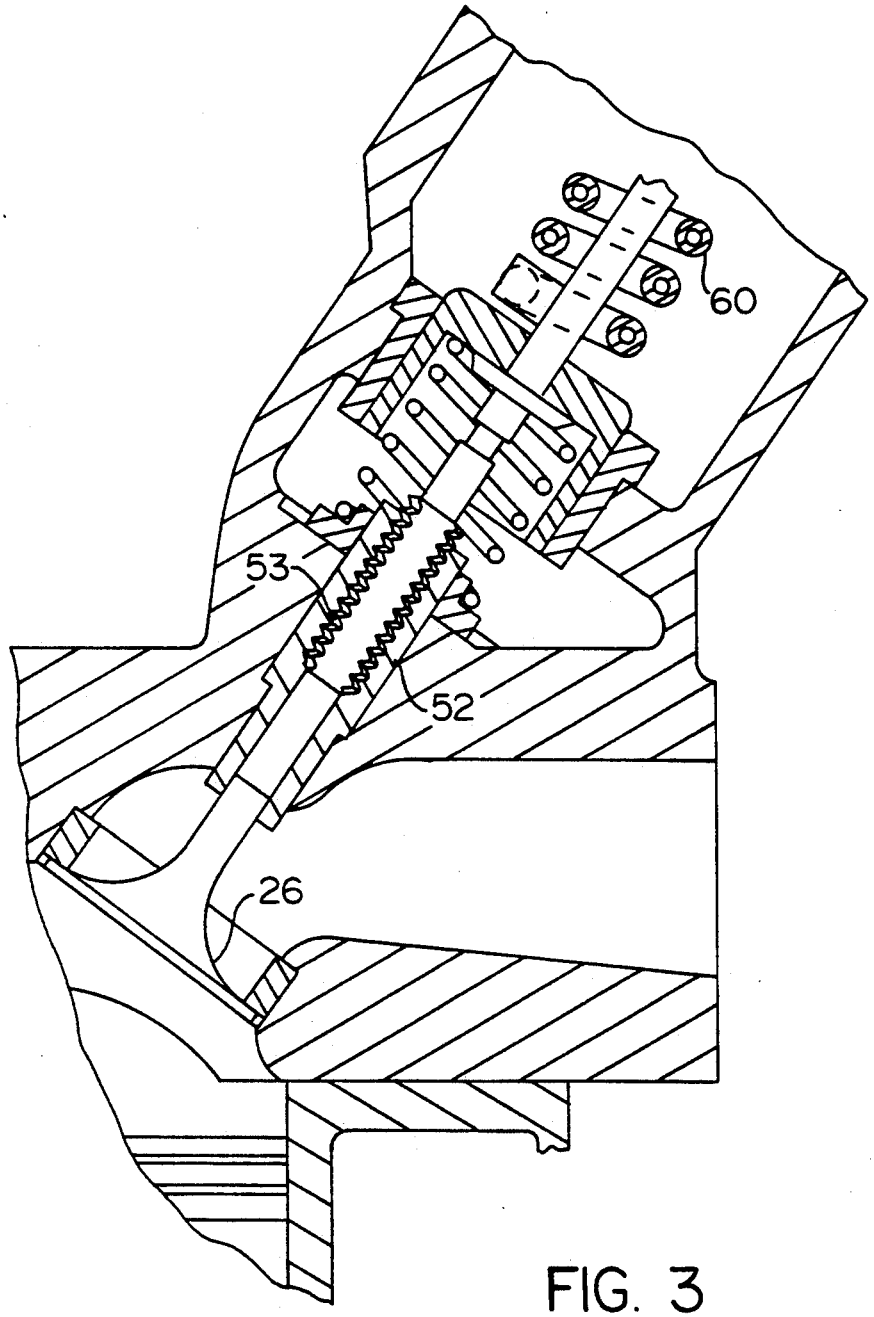
FIG. 3 shows a schematic view of a segmented screw poppet valve according to the present invention.
Figure 4A:
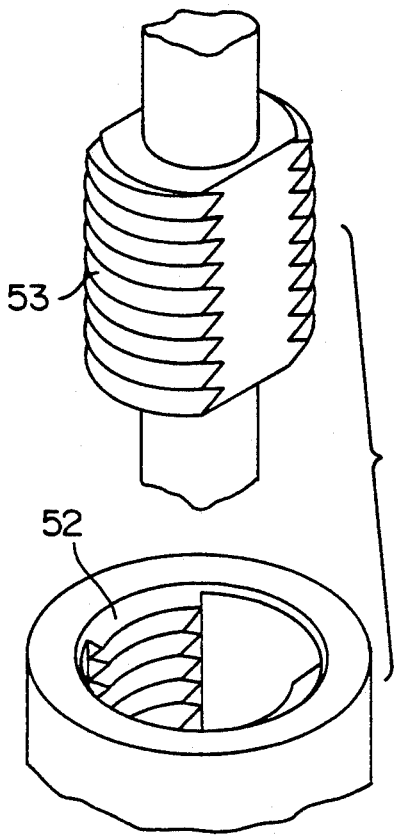
FIG. 4A shows a perspective view, disassembled, of the segmented screw poppet valve shown in FIG. 3.
Figure 4B:
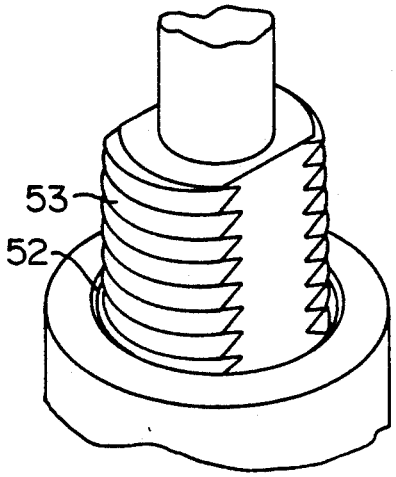
FIG. 4B shows a perspective view of the segmented screw poppet valve shown in FIG. 3 partially inserted.
Figure 4C:
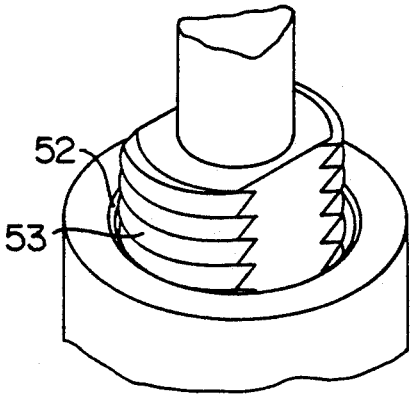
FIG. 4C shows a perspective view of the segmented screw poppet valve shown in FIG. 3 fully inserted.
Figure 4D:
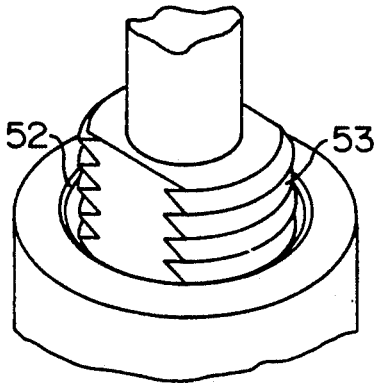
FIG. 4D shows a perspective view of the segmented screw poppet valve shown in FIG. 3 inserted and rotated 90°.

An alternative embodiment of the invention is shown in FIG. 3. This embodiment uses a segmented screw 50 to hold poppet valve 26 in the open or closed position. Segmented screw 50 is comprised of housing threads 52, and poppet threads 53 on the stem of valve 26. Coil 60, shown schematically, is used to rotate the poppet valve from a position where threads 53 engage housing threads 52, shown in perspective in FIG. 4D, to a disengaged position so that valve 26 can be moved inward or outward. FIG. 4B shows threads in the disengaged position, with valve 26 partially open. FIG. 4C shows the position of threads 52 with valve 26 fully open and FIG. 4D shows valve 26 rotated 90° to engage threads. In this embodiment the amount the valve is open may be adjusted.

In one embodiment of the invention, threads may be engaged to hold the valve 26 in either a closed or an open position. Thus, the valve would be rotated approximately 90° , moved from the closed to the open position, and then rotated 90° to be held in that position.

In the present embodiment of the invention, shown in FIG. 3, spring 28 is used to hold intake valve 26 against backseat 21, thus the threads do not need to be engaged when the valve 26 is in the shut position. Coil 60 may also be used to both rotate valve 26, and provide axial movement for opening and closing valve 26. Other rotational and retraction means may be appropriate.

Those skilled in the art will understand that the scope of the invention is broader than the specific embodiments described above. For example, the poppet valve may be moved and held open, or shut, for a variable amount of time, and opened a variable degree, by a worm gear on other similar means.

What is claimed is:

1. A poppet valve operating mechanism for an internal combustion engine comprising:

a poppet valve;

a cam having a raised portion for depressing and opening said poppet valve;

a holding means, on a cam follower which contacts said poppet valve, interacting with said cam to maintain said poppet valve in one of two stable positions; and a stepper motor for rotating said cam wherein said poppet valve may be maintained in at least one of an open position and a shut position without maintaining said motor energized.

2. A mechanism as in claim 1 wherein a spring means holds said poppet valve shut against a backseat when said poppet valve is in a closed position.

3. A mechanism as in claim 1 wherein said holding means is a lip on said cam follower.

4. A mechanism as in claim 1 wherein said valve may be maintained open for an entire combustion cycle.

5. A mechanism as in claim 1 wherein said valve may be maintained shut for an entire combustion cycle.

6. A mechanism as in claim 1 wherein said poppet valve may be opened a variable with respect to time and lift.

7. A mechanism as in claim 1, wherein said poppet valve is at least one of an intake valve and an exhaust valve.

* * * * *